US011918930B2

(12) United States Patent
Tan

(10) Patent No.: US 11,918,930 B2
(45) Date of Patent: Mar. 5, 2024

(54) CONNECTING STRUCTURE FOR TOY TENT

(71) Applicant: JAM'N PRODUCTS INC., Vernon, CA (US)

(72) Inventor: Shuxiong Tan, Shantou (CN)

(73) Assignee: JAM'N PRODUCTS, INC., Vernon, CA (US)

( * ) Notice: Subject to any disclaimer, the term of this patent is extended or adjusted under 35 U.S.C. 154(b) by 30 days.

(21) Appl. No.: 17/938,272

(22) Filed: Oct. 5, 2022

(65) Prior Publication Data

US 2023/0116989 A1 Apr. 20, 2023

(30) Foreign Application Priority Data

Oct. 15, 2021 (CN) ..... 202122494341.7
Dec. 9, 2021 (CN) ..... 202130813414.7

(51) Int. Cl.
*A63H 33/00* (2006.01)
*E04H 15/00* (2006.01)
*E04H 15/40* (2006.01)

(52) U.S. Cl.
CPC ..... *A63H 33/008* (2013.01); *E04H 15/40* (2013.01); *E04H 15/006* (2013.01)

(58) Field of Classification Search
CPC ..... E04H 15/40; E04H 15/006; A63H 33/008; A63H 33/101; A63H 33/108; E04B 1/1906; E04B 2001/1927; Y10T 403/342; Y10T 403/347
See application file for complete search history.

(56) References Cited

U.S. PATENT DOCUMENTS 1,483,165 A 2/1924 Eaton
3,458,949 A 8/1969 Young
3,632,147 A * 1/1972 Finger ..... A47F 5/14 403/171
3,982,841 A * 9/1976 Endzweig ..... E04B 1/1906 403/14
4,129,975 A * 12/1978 Gabriel ..... A63H 33/101 D8/382
D257,271 S 10/1980 Gabriel
4,271,628 A * 6/1981 Barlow ..... A63H 33/108 434/211

(Continued)

FOREIGN PATENT DOCUMENTS

DE 2731740 A1 1/1979
FR 2990481 A1 11/2013

(Continued)

*Primary Examiner* — Robert Sandy
*Assistant Examiner* — Rowland Do
(74) *Attorney, Agent, or Firm* — Lewis Roca Rothgerber Christie LLP

(57) ABSTRACT

A connection structure for toy tents having a first connection component, a second connection component and a connection buckle, the first connection component and the second connection component are clamped together, the connection buckle is clamped with the first connection component and the second connection component, an outer hemisphere of the first connecting assembly is clamped with an outer hemisphere of the second connecting assembly and an inner hemisphere of the first connecting assembly is clamped with the inner hemisphere of the second connecting assembly.

8 Claims, 8 Drawing Sheets

(56) References Cited

U.S. PATENT DOCUMENTS

| | | | | | |
|---|---|---|---|---|---|
| RE33,785 | E * | 12/1991 | Hildebrandt | A63F 9/12 | 434/211 |
| 5,074,700 | A * | 12/1991 | Swoboda | E04B 1/1906 | 403/348 |
| 5,265,395 | A * | 11/1993 | Lalvani | E04B 1/32 | 403/176 |
| 5,611,187 | A | 3/1997 | Jones | | |
| 6,491,563 | B1 * | 12/2002 | Bailey | A63H 33/062 | 446/120 |
| 6,672,789 | B2 * | 1/2004 | Chen | F16B 7/185 | 403/171 |
| 6,702,640 | B1 * | 3/2004 | Park | A63H 33/04 | 446/85 |
| 6,966,813 | B2 * | 11/2005 | Donahue | A63H 33/067 | 446/124 |
| 7,374,468 | B2 * | 5/2008 | Flodin | A63H 33/108 | 446/124 |
| 2004/0043164 | A1 * | 3/2004 | Vicentelli | A63H 33/046 | 428/34.1 |
| 2006/0084357 | A1 | 4/2006 | Rosen et al. | | |
| 2007/0281803 | A1 | 12/2007 | Jeong | | |
| 2009/0093182 | A1 * | 4/2009 | Jacobs | A63H 33/008 | 446/120 |
| 2010/0285718 | A1 | 11/2010 | Stone et al. | | |
| 2015/0104992 | A1 | 4/2015 | Jung | | |
| 2018/0250606 | A1 * | 9/2018 | Kalish | A63H 33/101 | |
| 2023/0114267 | A1 * | 4/2023 | Wilson, IV | A63H 33/044 | 446/120 |

FOREIGN PATENT DOCUMENTS

| | | | |
|---|---|---|---|
| IT | TO20090625 | A1 | 2/2011 |
| WO | 2012126442 | A1 | 9/2012 |
| WO | 2014013496 | A1 | 1/2014 |

* cited by examiner

CONNECTING STRUCTURE FOR TOY TENT

CROSS-REFERENCE TO RELATED APPLICATION(S)

This application claims priorities to Chinese Application No. 202122494341.7, filed on Oct. 15, 2021, and Chinese Application No. 202130813414.7, filed on Dec. 9, 2021, the disclosures of which are hereby incorporated by reference in their entireties.

TECHNICAL FIELD

The utility model belongs to the technical field of tents, in particular to a connection structure for toy tents.

BACKGROUND

Indoor children's toy tents are currently a new field in the development of toy tents. Toy tents are novel in structure and have high economic value. The existing indoor toy tents are divided into large playground tents and family-style small tents according to the occasion of use; according to their functions, they are divided into pitching tents, ocean ball tent, simulated beach tent, rest tent, dress up tent, etc.

At present, the structure of children's toy tents on the market is elastic steel wire and glass fiber rods or hoses, which need to be fitted with various joints and can only be assembled by manpower to complete a toy tent. The general toy tents are not easy to install, and it is not easy to fix the skeleton. The stability of the installed toy tent is poor. For this reason, the present invention is a connection structure for toy tents to solve the above technical problems.

SUMMARY OF THE INVENTION

A purpose of the present invention is to provide a connection structure for toy tents, which solves the problem of existing toy tents. The tent is not easy to install, it is not easy to fix the frame, and the stability of the toy tent after the installation is poor. The connection structure of the present invention includes a buckle, an outer hemisphere, an inner hemisphere, a positioning column, a positioning tube, a limiting tube and a limiting column.

In order to solve the above technical problems, the present invention is realized through the following technical solutions:

The invention relates to a connection structure for a toy tent, which includes a first connection component, a second connection component and a connection buckle; the first connection component and the second connection component are clamped together; the connection buckle is connected with each other. The first connecting component and the second connecting component are clamped; the first connecting component and the second connecting component each include an outer hemisphere and an inner hemisphere; the outer hemisphere and the inner hemisphere are coaxial; the first outer hemisphere of a connecting assembly is clamped with the outer hemisphere of the second connecting assembly; the inner hemisphere of the first connecting assembly is clamped with the inner hemisphere of the second connecting assembly.

Further, a surface of the outer hemisphere of the first connecting component is fixed with a plurality of clips along the circumferential direction. A surface of the outer hemisphere of the second connecting component is provided with a plurality of clamping grooves along the circumferential direction, and the clamping grooves are clamped with the clamping block.

Further, the inner wall of the outer hemisphere is fixed with a number of arc-shaped support plates along the circumferential direction; the arc-shaped support plate is attached to the outer wall of the inner hemisphere. A number of clamping posts are fixed on the inner wall of the outer hemisphere; the clamping posts are clamped with the inner hemisphere.

Further, the inner wall of the outer hemisphere of the first connecting component is fixed with a number of positioning posts along the circumferential direction. The inner wall of the inner hemisphere of the first connecting component is provided with a plurality of first through holes, and the first through holes are in sliding fit with the positioning posts.

Further, the inner wall of the outer hemisphere of the second connecting assembly is fixed with a plurality of positioning tubes along the circumferential direction. A plurality of second through holes are opened on the inner wall of the inner hemisphere of the second connecting component, and the second through holes are in sliding fit with the positioning tube. The peripheral side of the positioning column is clamped with the inner wall of the positioning tube.

Further, the inner wall of the inner hemisphere of the first connecting component is fixed with a number of limit tubes along the circumferential direction. The inner wall of the inner hemisphere of the second connecting component is fixed with a number of limit posts along the circumferential direction; the peripheral side of the limit posts is clamped with the inner wall of the limit tube.

Further, the outer wall of the outer hemisphere is respectively provided with an outer mounting hole and an outer semicircular hole. The outer wall of the inner hemisphere is respectively provided with an inner mounting hole and an inner semicircular hole.

The outer mounting hole and the outer semicircular hole have the same diameter, and the inner mounting hole and the inner semicircular hole have the same diameter. The outer semicircular hole on the outer hemisphere of the first connecting component is coaxial with the outer semicircular hole on the outer hemisphere of the second connecting component. The inner semicircular hole on the inner hemisphere of the first connecting assembly is coaxial with the inner semicircular hole on the inner hemisphere of the second connecting assembly.

Further, the connecting buckle is composed of an outer fastener and an inner fastener that are fixedly connected to each other. The peripheral side surface of the outer fastener is in clearance fit with the inner wall of the outer mounting hole and the inner wall of the outer semicircular hole respectively. The peripheral side surface of the inner fastener is in clearance fit with the inner wall of the inner mounting hole and the inner wall of the inner semicircular hole respectively.

A number of protruding clamping points are fixed on the outside of the inner fastener; the protruding clamping points are clamped with the inner wall of the inner hemisphere.

The invention has the following beneficial effects:

First, the connection adopts the design of outer hemisphere, outer installation hole, outer semicircular hole, inner hemisphere, inner installation hole, inner semicircle hole, connection buckle and protruding buckle, and utilizes connection buckle and outer hemisphere and inner hemisphere. The clamping function of the hemisphere buckles the protruding clamping points on the inner surface of the inner hemisphere, thereby realizing the connection of the connecting buckle with the first connecting component and the second connecting component, facilitating the installation of the skeleton, and making the installation of the skeleton stronger and firmer.

Secondly, through the design of positioning column, positioning tube, limiting tube and limiting column, this connection can realize the clamping connection of the first connecting component and the second connecting component, using a double-layer sphere composed of an outer hemisphere and an inner hemisphere, Which greatly increases the firmness of the connection between the frame of the toy tent and the connection buckle, thereby increasing the stability of the toy tent. Of course, any product implementing the present invention does not necessarily need to achieve all the advantages described above at the same time.

BRIEF DESCRIPTION OF THE DRAWINGS

In order to explain the technical solutions of the embodiments of the present invention more clearly, the following will briefly introduce the drawings used in the description of the embodiments.

Figure 1:
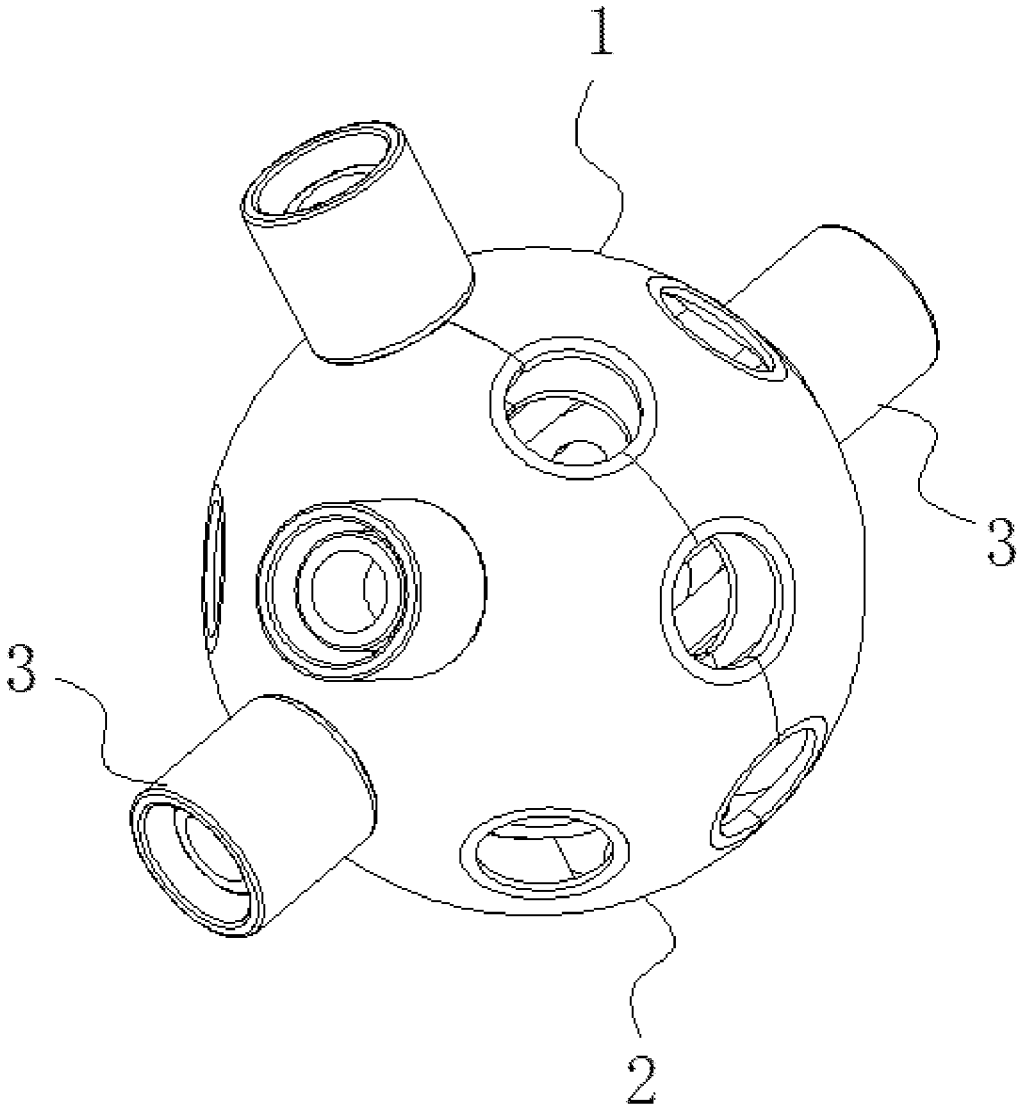
FIG. 1 is a perspective view of a connection structure for a toy tent.

In the drawings, the list of parts represented by each number is as follows:

1 is a first connecting component, 2 is a second connecting component, 3 is a connecting buckle, 301 is an outer fastener, 302 is an inner fastener, 303 is a protruding point, 4 is an outer hemisphere, 401 is a block, 402 is a curved support plate, 403 is a clamping column, 404 is a positioning column, 405 is a positioning tube, 406 is an outer mounting hole, 407 is an outer semicircular hole, 5 is an inner hemisphere, 501 is a limiting tube, 502 is a limiting column, 503 is an inner mounting hole, and 504 is an inner semicircular hole.

DETAILED DESCRIPTION

The following will clearly and completely describe the technical solutions in the embodiments of the present invention with reference to the accompanying drawings in the embodiments of the present invention. The described embodiments are only a part of the embodiments of the present utility model, not all implementations. Based on the embodiments of the present invention, all other embodiments obtained by those of ordinary skill in the art without creative work shall fall within the protection scope of the present invention.

Figure 2:
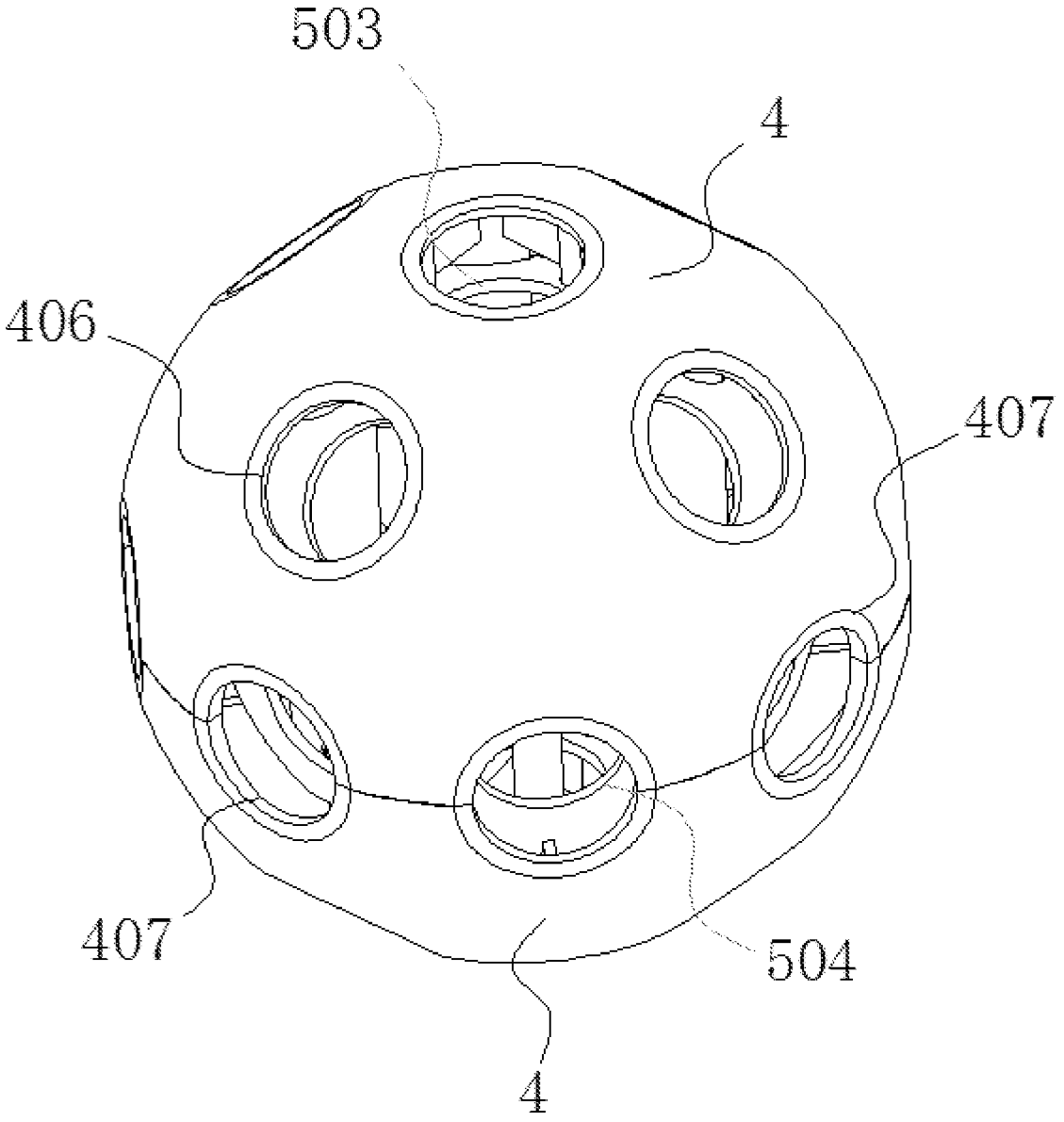
FIG. 2 is a perspective of a part of the connection structure of FIG. 1.
Figure 3:
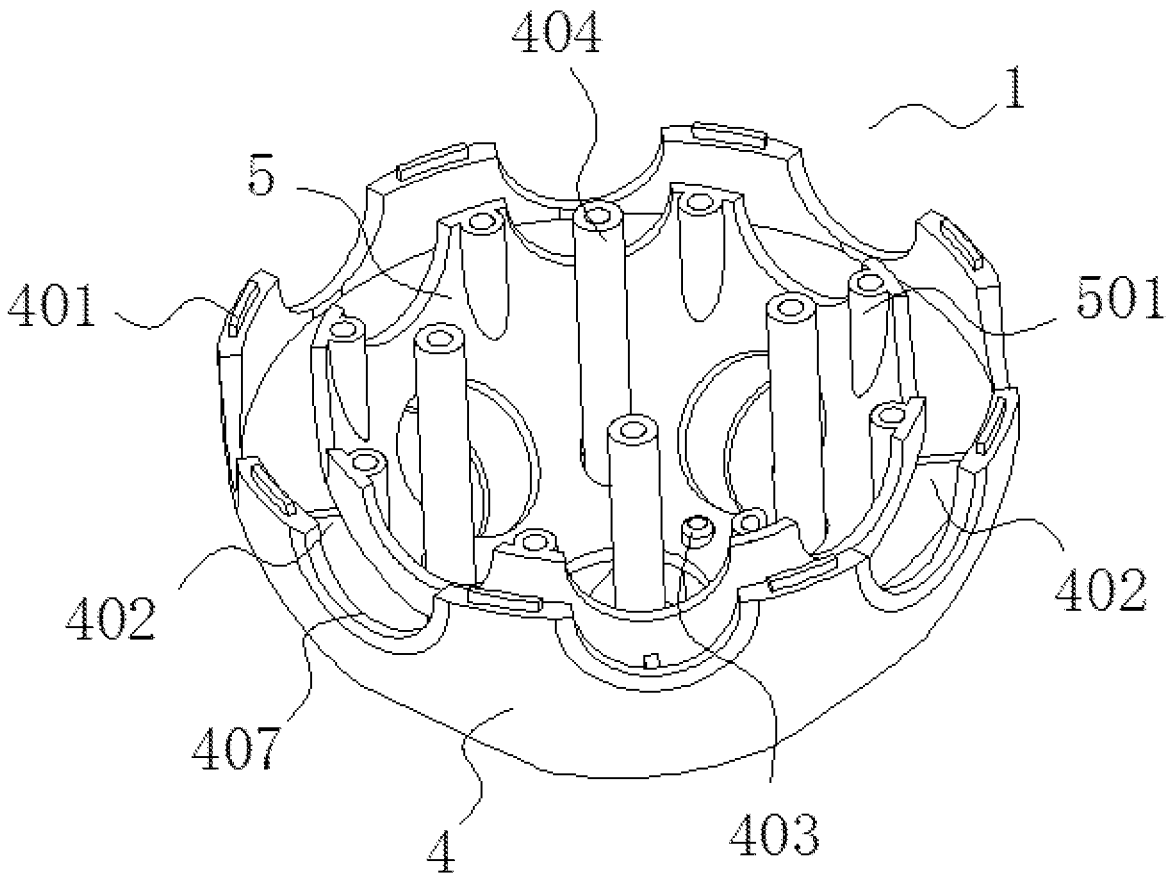
FIG. 3 is a perspective view of the structure of the first connecting component.
Figure 4:
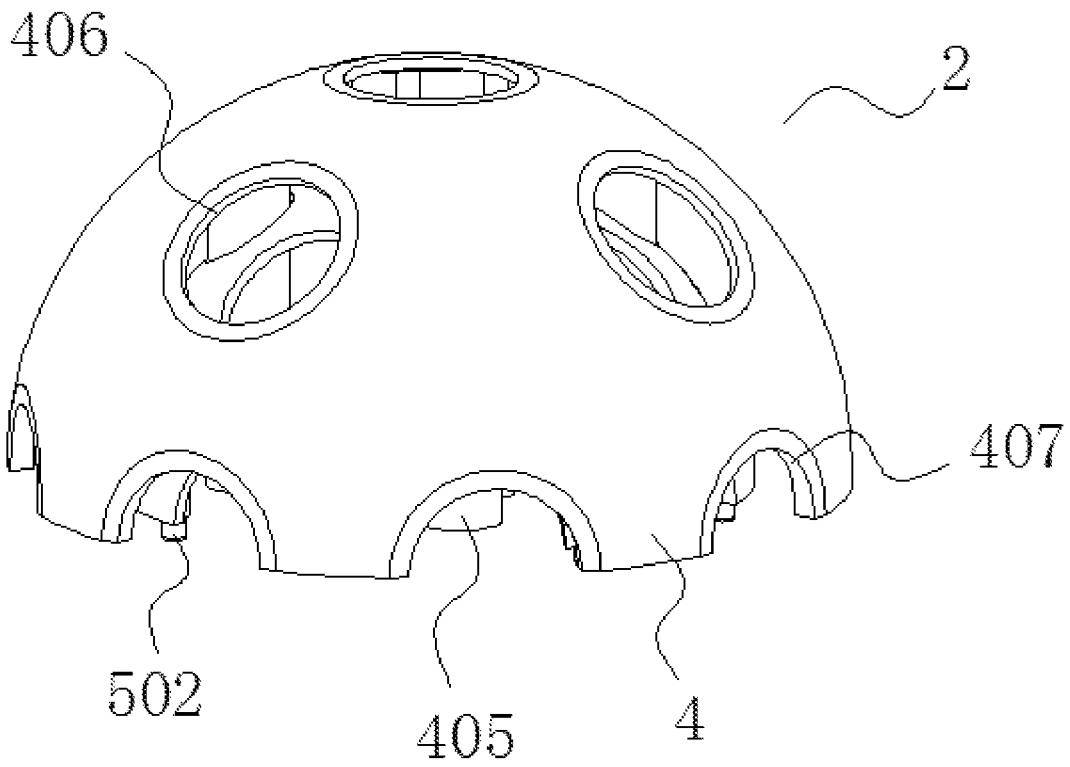
FIG. 4 is a perspective view of the structure of the second connecting component.
Figure 5:
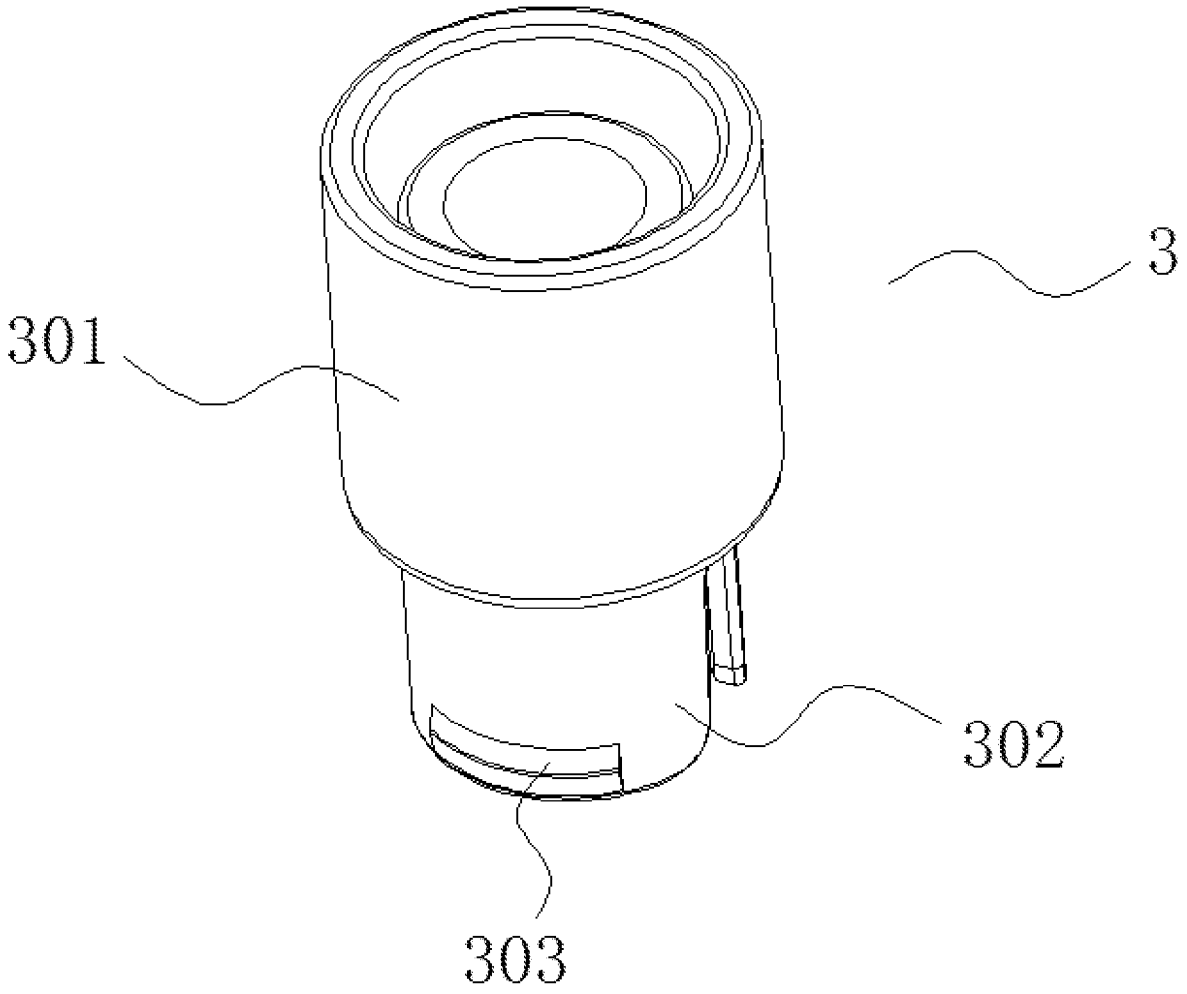
FIG. 5 is a perspective view of the structure of the connecting buckle.
Figure 6:
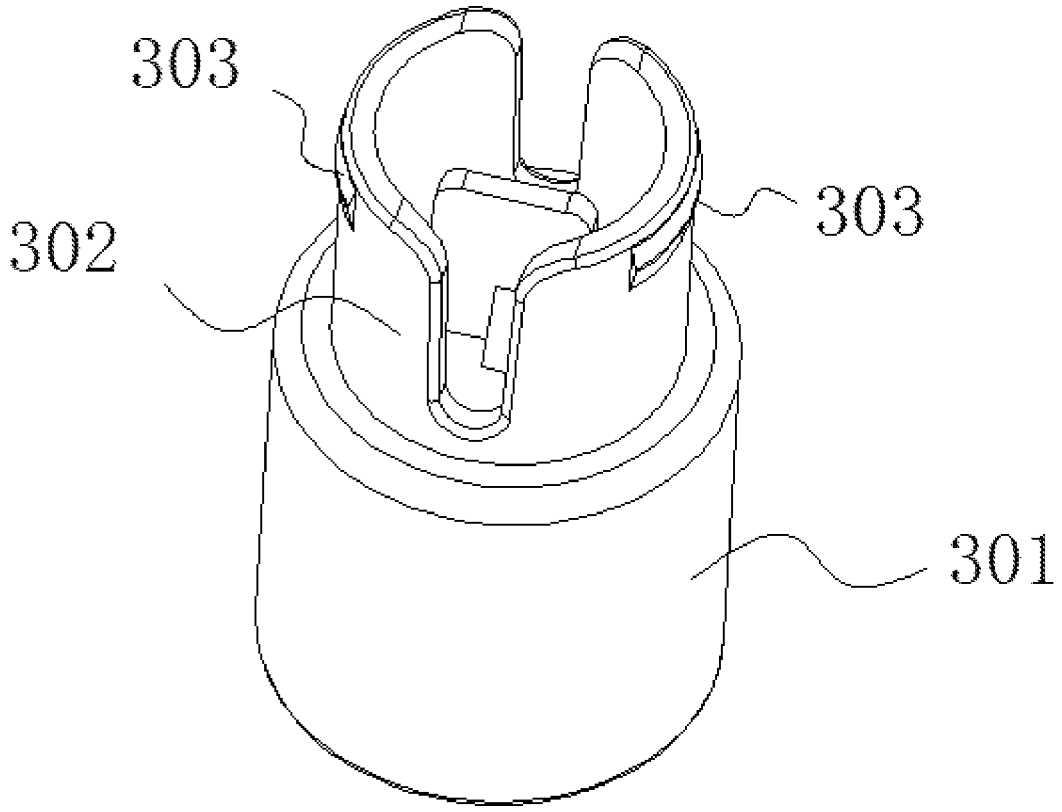
FIG. 6 is a perspective view of the structure of FIG. 5 from another angle.
Figure 7:
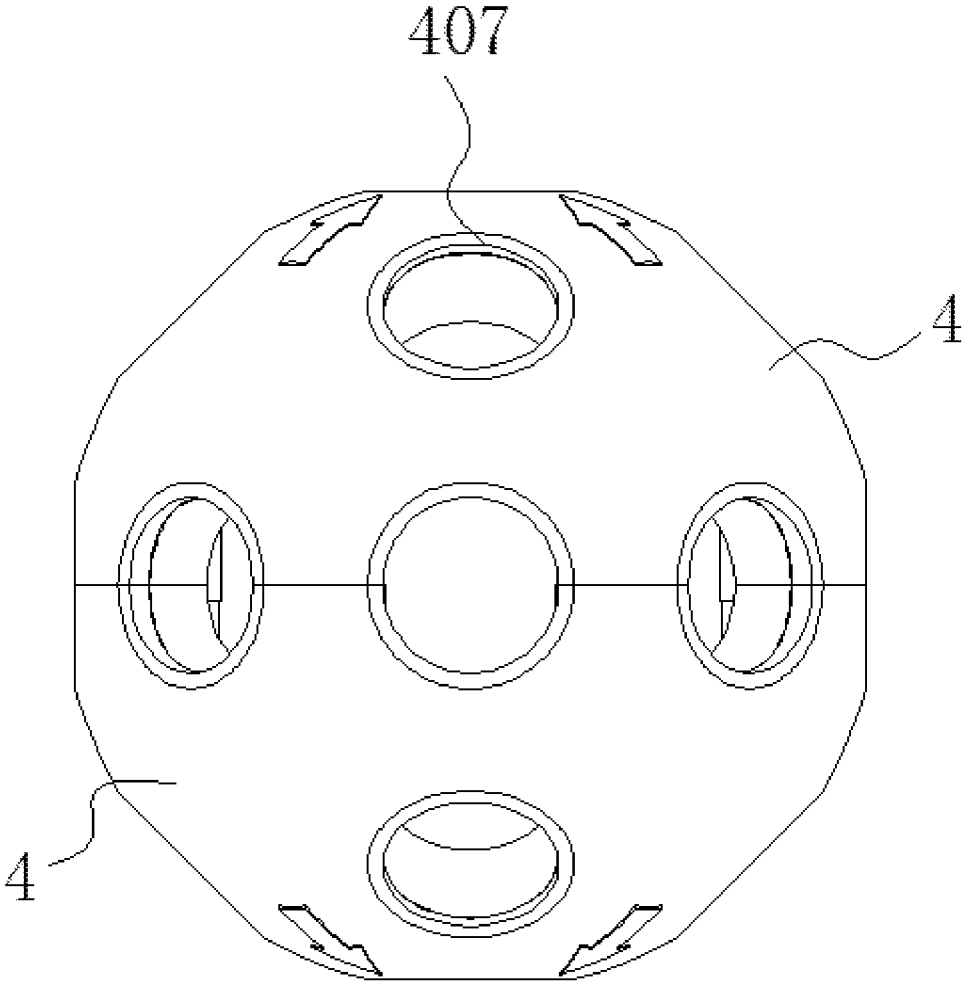
FIG. 7 is a front view of the structure of FIG. 2.
Figure 8:
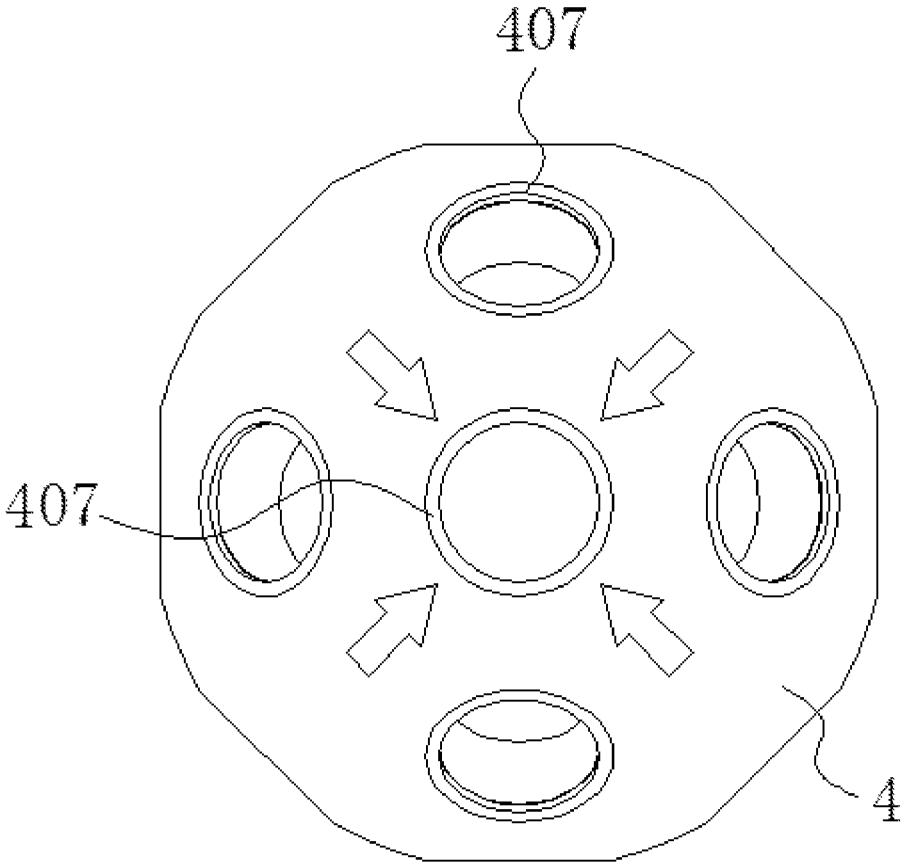
FIG. 8 is a top view of the structure of FIG. 2.

Referring to FIGS. 1-8 the present invention is a connection structure for toy tents, which includes a first connection component 1, a second connection component 2 and a connection buckle 3. The first connecting component 1 and the second connecting component 2 are snap-connected to facilitate the installation and disassembly of the entire toy tent connection structure.

Connection buckles 3 are respectively clamped with the first connection component 1 and the second connection component 2. After the connection buckles 3 are clamped on the first connection component 1 and the second connection component 2, the toy tent frame can be inserted and connected to the connection buckle 3.

The first connecting component 1 and the second connecting component 2 both include an outer hemisphere 4 and an inner hemisphere 5. The outer hemisphere 4 and the inner hemisphere 5 are coaxial, thereby forming a double-layer sphere, which greatly improves the connection buckle 3 and the firmness of the connection between the outer hemisphere 4 and the inner hemisphere 5.

The outer hemisphere 4 of the first connecting assembly 1 is clamped to the outer hemisphere 4 of the second connecting assembly 2. The inner hemisphere 5 of the first connecting assembly 1 is clamped to the inner hemisphere 5 of the second connecting assembly 2.

Wherein, a surface of the outer hemisphere 4 of the first connecting assembly 1 is fixed with a plurality of clamping blocks 401 along the circumferential direction. A surface of the outer hemisphere 4 of the second connecting assembly 2 is provided with a plurality of clamping grooves along the circumferential direction, and the clamping grooves and the clamping block 401 are clamped, which can effectively prevent the relative rotation between the two outer hemispheres 4 in the connection structure, and the stability of the connection between the outer hemisphere 4 of the first connecting assembly 1 and the outer hemisphere 4 of the second connecting assembly 2 is increased.

An inner wall of the outer hemisphere 4 is fixed with a number of arc-shaped support plates 402 along the circumferential direction. The arc-shaped support plate 402 is attached to the outer wall of the inner hemisphere 5 to avoid the shaking of the inner sphere formed by the two inner hemispheres 5.

A number of clamping posts 403 are fixed on the inner wall of the outer hemisphere 4. The clamping posts 403 and the inner hemisphere 5 are clamped to facilitate the fixed connection of the inner hemisphere 5 inside the corresponding outer hemisphere 4. The inner wall of the outer hemisphere 4 of the first connecting assembly 1 is fixed with a number of positioning posts 404 along the circumferential direction.

The inner wall of the inner hemisphere 5 of the first connecting assembly 1 is provided with a number of first through holes, and the first through holes are in sliding fit with the positioning pillars 404. Through the positioning of the positioning pillars 404, when the inner hemisphere 5 is clamped to the corresponding outer, when the hemisphere 4 is inside, the inner hemisphere 5 can be limited to a certain extent, and the position of the inner hemisphere 5 can be effectively prevented from moving.

The inner wall of the outer hemisphere 4 of the second connecting assembly 2 is fixed with a number of positioning tubes 405 along the circumferential direction. The inner wall of the inner hemisphere 5 of the second connecting assembly 2 is provided with a number of second through holes, and the second through holes are in sliding fit with the positioning tube 405. Through the positioning of the positioning tube 405, when the inner hemisphere 5 is clamped to the corresponding outer hemisphere, when the hemisphere 4 is inside, the inner hemisphere 5 can be limited to a certain extent, and the position of the inner hemisphere 5 can be effectively prevented from moving.

The peripheral side surface of the positioning column 404 is clamped with the inner wall of the positioning tube 405, so that the clamp connection between the two outer hemispheres 4 can be realized. Wherein, the inner wall of the inner hemisphere 5 of the first connecting assembly 1 is fixed with a number of limit tubes 501 along the circumferential direction.

The inner wall of the inner hemisphere 5 of the second connecting assembly 2 is fixed with a number of limit posts 502 along the circumferential direction. Wherein, the outer wall of the outer hemisphere 4 is respectively provided with an outer mounting hole 406 and an outer semicircular hole 407. The outer wall of the inner hemisphere 5 is respectively provided with an inner mounting hole 503 and an inner semicircular hole 504.

The outer mounting hole 406 and the outer semicircular hole 407 have the same diameter. When the two outer hemispheres 4 are clamped to each other, the round hole formed by the corresponding two outer semicircular holes 407 has the same size as the outer mounting hole 406. The inner mounting hole 503 and the inner semicircle and the holes 504 have the same diameter. When the two inner hemispheres 5 are clamped to each other, the round hole formed by the corresponding two inner hemispherical holes 504 has the same size as the inner mounting hole 503.

The outer semicircular hole 407 on the outer hemisphere 4 of the first connecting assembly 1 is coaxial with the outer semicircular hole 407 on the outer hemisphere 4 of the second connecting assembly 2. The inner semicircular hole 504 on the inner hemisphere 5 of the first connecting assembly 1 is coaxial with the inner semicircular hole 504 on the inner hemisphere 5 of the second connecting assembly 2.

Among them, the connecting buckle 3 is composed of an outer fastener 301 and an inner fastener 302 that are fixedly connected to each other. The peripheral side of the outer fastener 301 is in clearance fit with the inner wall of the outer mounting hole 406 and the inner wall of the outer semicircular hole 407 respectively. The peripheral side surface of the inner fastener 302 is in clearance fit with the inner wall of the inner mounting hole 503 and the inner wall of the inner semicircular hole 504 respectively.

The inner fastener 302 is externally fixed with a number of protruding points 303. The protruding points 303 are clamped to the inner wall of the inner hemisphere 5, and the protruding points 303 are used to buckle at the round holes on the surface of the sphere, which are used to connect the toy tent to make the skeleton more convenient when fixed, stronger and firmer.

The embodiments of the connection structure of the present invention disclosed above are only used to help explain the invention. Many modifications and changes can be made according to the content of this description. This specification selects and specifically describes these embodiments in order to better explain the principles and practical applications of the connection structure of the present invention so that those skilled in the art can understand and use the invention.

What is claimed is:

1. A connection structure for toy tents comprising:

a first connection component;

a second connection component; and a connection buckle;

the first connection component and the second connection component are snap-connected;

the connection buckle is clamped with the first connection component and the second connection component;

the first connection component and the second connection component both include an outer hemisphere and an inner hemisphere;

the outer hemisphere of the first connection component is clamped to the outer hemisphere of the second connection component; and the inner hemisphere of the first connection component is clamped with the inner hemisphere of the second connection component.

2. The connection structure according to claim 1, wherein a surface of the outer hemisphere of the first connection component is fixed with a plurality of clamping blocks along a circumferential direction; and a surface of the outer hemisphere of the second connection component is provided with a plurality of clamping grooves along a circumferential direction, and the clamping grooves are clamped with the clamping blocks.

3. The connection structure according to claim 1, wherein an inner wall of the outer hemisphere of the first connection component includes a plurality of arc-shaped support plates along a circumferential direction;

the arc-shaped support plates fit with an outer wall of the inner hemisphere of the second connection component; and a number of clamping posts are fixed on an inner wall of the outer hemisphere of the first connection component, wherein the clamping posts and the inner hemisphere of the second connection component are clamped together.

4. The connection structure according to claim 1, wherein an inner wall of the outer hemisphere of the first connection component are fixed with a number of positioning posts along a circumferential direction;

the inner wall of the inner hemisphere of the first connection component has a plurality of first through holes, and the first through holes are in sliding fit with a positioning column.

5. The connection structure according to claim 4, wherein the inner wall of the outer hemisphere of the second connection assembly has a plurality of positioning tubes in a circumferential direction;

the inner wall of the inner hemisphere of the second connection component has a plurality of second through holes in sliding fit with the positioning tubes;

the peripheral side of the positioning column is clamped with the inner wall of a positioning tube of the plurality of positioning tubes.

6. The connection structure according to claim 1, wherein the inner wall of the inner hemisphere of the first connection component has a plurality of limit tubes along a circumferential direction;

the inner wall of the inner hemisphere of the second connecting component has a plurality of limit posts along a circumferential direction;

the limit posts are clamped with an inner wall of the limit tubes.

7. The connection structure according to claim 1, wherein the outer wall of the outer hemisphere has an outer mounting hole and an outer semicircular hole;

the outer wall of the inner hemisphere has an inner mounting hole and an inner semicircular hole;

the outer mounting hole and the outer semicircular hole have the same diameter, and the inner mounting hole and the inner semicircular hole have the same diameter;

the outer semicircular hole on the outer hemisphere of the first connection component is coaxial with the outer semicircular hole on the outer hemisphere of the second connecting component; and the inner semicircular hole on the inner hemisphere of the first connection component is coaxial with the inner semicircular hole on the inner hemisphere of the second connection component.

8. The connection structure according to claim 7, wherein the connection buckle is composed of an outer fastener and an inner fastener fixedly connected to each other;

a peripheral side surface of the outer fastener is in clearance fit with an inner wall of the outer mounting hole and an inner wall of the outer semicircular hole;

a peripheral side surface of the inner fastener is in clearance fit with an inner wall of the inner mounting hole and an inner wall of the inner semicircular hole;

a plurality of protruding clamping points are fixed on an outside surface of the inner fastener, and the protruding clamping points are clamped with the inner wall of the inner hemisphere.

* * * * *